US008597051B2

(12) United States Patent
Yang et al.

(10) Patent No.: US 8,597,051 B2
(45) Date of Patent: Dec. 3, 2013

(54) RECEPTACLE CONNECTOR

(75) Inventors: Cheng-Wang Yang, Guang-Dong (CN); Chao-Yong Ye, Guang-Dong (CN); Kai-Hsiang Chang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 106 days.

(21) Appl. No.: 13/411,509

(22) Filed: Mar. 2, 2012

(65) Prior Publication Data

US 2013/0231004 A1 Sep. 5, 2013

(51) Int. Cl.
*H01R 13/40* (2006.01)

(52) U.S. Cl.
USPC ..... 439/589; 439/607.36

(58) Field of Classification Search
USPC ..... 439/271, 281, 287, 587, 589, 607.21, 439/607, 23, 607.36, 607.6, 607.24
See application file for complete search history.

(56) References Cited

U.S. PATENT DOCUMENTS 6,994,591 B2 * 2/2006 Huang ..... 439/607.36
7,934,957 B1 * 5/2011 Nakajima et al. ..... 439/607.49
8,011,956 B1 * 9/2011 Yang et al. ..... 439/589
8,021,187 B2 * 9/2011 Tagawa et al. ..... 439/607.31
8,282,417 B2 * 10/2012 Xiao ..... 439/607.36
8,292,662 B2 * 10/2012 Yang et al. ..... 439/587
8,292,674 B1 * 10/2012 Yang et al. ..... 439/660
8,317,543 B2 * 11/2012 Tagawa et al. ..... 439/607.36

* cited by examiner

*Primary Examiner* — Xuong Chung Trans
(74) *Attorney, Agent, or Firm* — Cheng-Ju Chiang

(57) ABSTRACT

A receptacle connector adapted for soldering with a circuit board and engaging with a plug connector includes an insulating housing, a plurality of terminals molded in the insulating housing, at least two first connecting elements, a second connecting element, a first waterproof board, a second waterproof board, and a shielding shell surrounding the insulating housing. The insulating housing has a top wall which defines at least two locating grooves for receiving the first connecting elements therein. The second connecting element has a base plate mounted to a bottom of the bottom wall. The first waterproof board is mounted to a top of the insulating housing. The second waterproof board is mounted under the second connecting element. A top face of the first waterproof board and a bottom face of the second waterproof board are coated with waterproof adhesive material to form a waterproof adhesive layer respectively.

6 Claims, 3 Drawing Sheets

RECEPTACLE CONNECTOR

BACKGROUND OF THE INVENTION

1. Field of the Invention

The present invention generally relates to a receptacle connector, and more particularly to a waterproof receptacle connector.

2. The Related Art

Nowadays, electronic technology has developed faster and faster, so a variety of electronic products have been developed accordingly, and play an important role in people's daily lives. Meanwhile, receptacle connectors are assembled in the electronic products, such as cell phones, cameras, personal computers and so on, to complete diversified functions of the electronic products. The receptacle connector generally includes an insulating housing and a plurality of terminals. The insulating housing has a base wall, a top wall extending forward from a top of the base wall, two side walls extending downward from two opposite sides of the top wall, and a bottom wall connecting with the two side walls and the base wall. An accommodating chamber for receiving a plug connector therein is formed among the base wall, the top wall, the bottom wall and the two side walls. A middle of a front of the base wall protrudes forward to form a tongue portion projecting into the accommodating chamber. The insulating housing defines a plurality of terminal grooves each extending longitudinally along a top of the tongue portion and further penetrating through the base wall. The terminals are disposed in the terminal grooves.

However, when moisture enters a cover of the electronic product, the moisture is extremely apt to permeate into the accommodating chamber through the insulating housing that results in a poor electrical contact between the receptacle connector and the plug connector. Thus, a normal electrical performance of the electronic product is seriously affected.

SUMMARY OF THE INVENTION

An object of the present invention is to provide a receptacle connector adapted for soldering with a circuit board and engaging with a plug connector includes an insulating housing, a plurality of terminals, at least two first connecting elements, a second connecting element, a first waterproof board, a second waterproof board and a shielding shell. The insulating housing has a base wall, a top wall, two side walls and a bottom wall which are interconnected with one another to form an accommodating chamber thereamong for inserting the plug connector therein. A front of the base wall protrudes forward to form a tongue portion projecting in the accommodating chamber. The insulating housing defines a plurality of terminal grooves of which each extends longitudinally along a top of the tongue portion and further penetrates through the base wall. The top wall defines at least two locating grooves with middles thereof vertically penetrating through the top wall to communicate with the accommodating chamber. The bottom wall defines at least two circular holes communicating with the accommodating chamber. The terminals are molded in the terminal grooves of the insulating housing with front ends thereof exposed in the top of the tongue portion to electrically contact with the plug connector, and rear ends thereof projecting out of the insulating housing through the base wall to be soldered on the circuit board. The first connecting elements are located in the locating grooves with middles thereof projecting into the accommodating chamber through the middles of the locating grooves. Two opposite sides of each first connecting element protrude upward to form two first fastening portions. The second connecting element has a base plate mounted to a bottom of the bottom wall. A front side of the base plate defines at least two mouths. One inner end of each mouth inclines upward and extends towards the other inner end of the mouth to form a cantilever arm. A free end of the cantilever arm spreads outward and protrudes upward to form a touching portion projecting into the accommodating chamber through the circular hole. At least two second fastening portions are punched downward from a top of the base plate and located between the two mouths. The first waterproof board is mounted to a top of the top wall of the insulating housing, and defines a plurality of first fastening holes for receiving the first fastening portions therein. The second waterproof board is mounted under the second connecting element, and defines at least two second fastening holes for receiving the second fastening portions therein. A top face of the first waterproof board and a bottom face of the second waterproof board are coated with waterproof adhesive material to form a waterproof adhesive layer respectively. The shielding shell surrounds the insulating housing together with the first waterproof board and the second waterproof board.

As described above, the top face of the first waterproof board and the bottom face of the second waterproof board are coated with waterproof adhesive material to form the waterproof adhesive layer respectively to seal up the interstices between the first fastening portions and the first fastening holes, and the interstices between the second fastening portions and the second fastening holes to prevent moisture entering the accommodating chamber from a top and a bottom of the insulating housing so as to make the receptacle connector contact with the plug connector steadily. Thus, a normal electrical performance of an external electronic product with the receptacle connector mounted thereto is assured. Furthermore, a top of the shielding shell connects with the first connecting elements and ground elements by means of a laser welding technology to connect the shielding shell with the first connecting elements and the ground elements firmly so as to make the first connecting elements and the ground elements effectively contact with the plug connector. A bottom of the shielding shell connects with the second connecting element by means of the laser welding technology to connect the shielding shell with the second connecting element firmly so as to make the second connecting element effectively contact with the plug connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
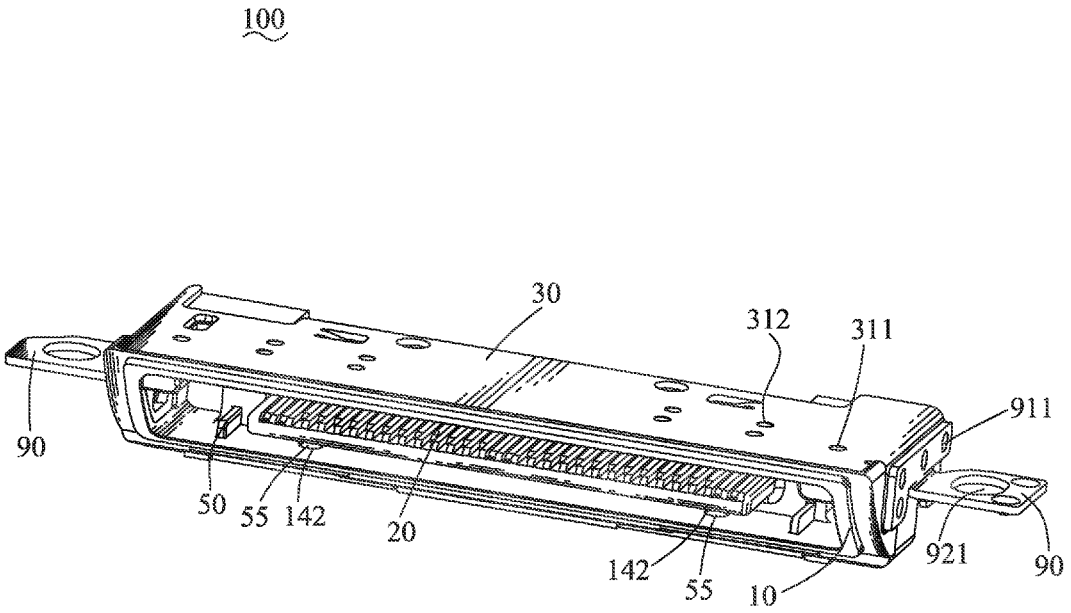
FIG. 1 is a perspective view of a receptacle connector in accordance with the present invention.
Figure 2:
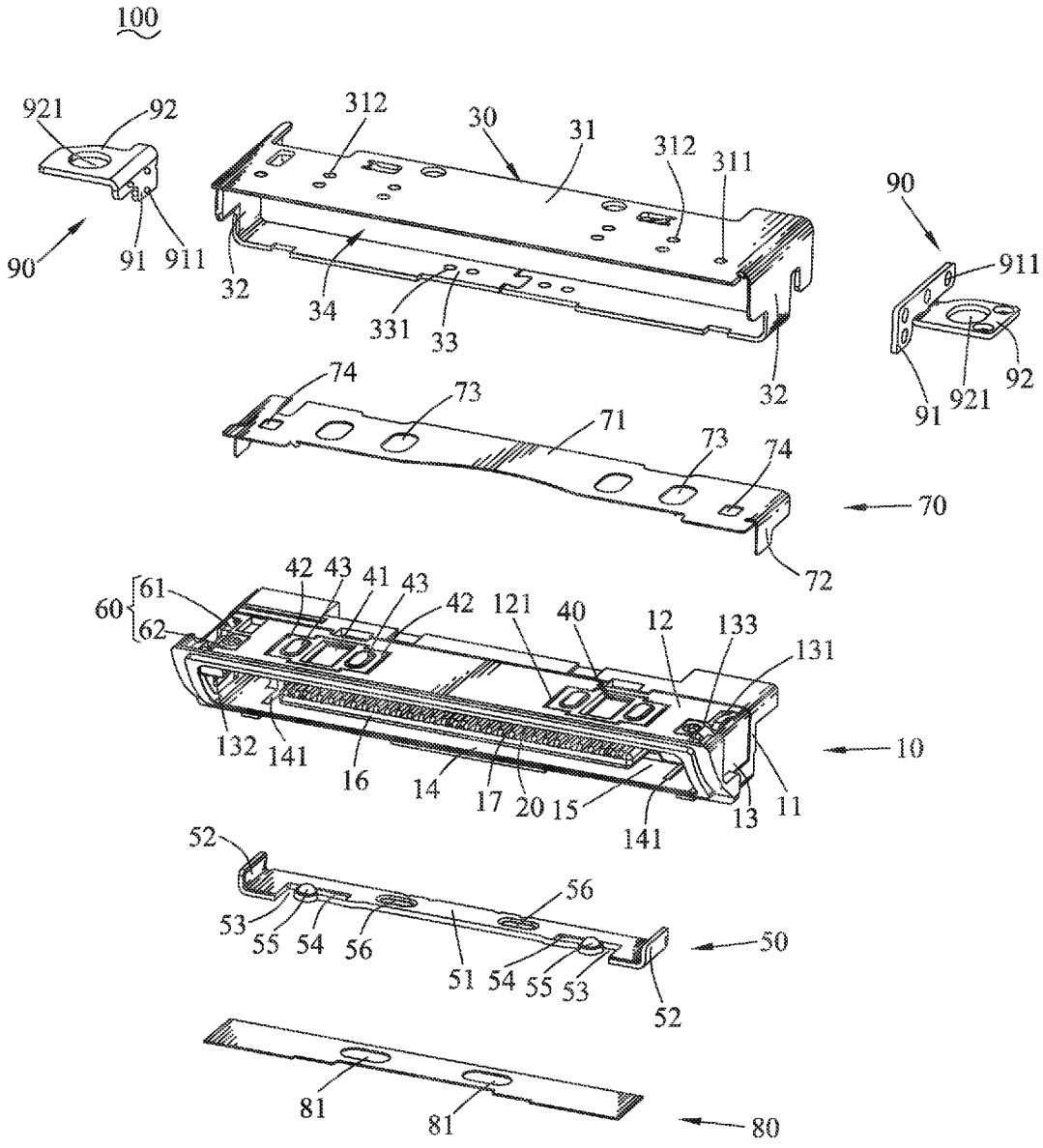
FIG. 2 is an exploded view of the receptacle connector of FIG. 1.
Figure 3:
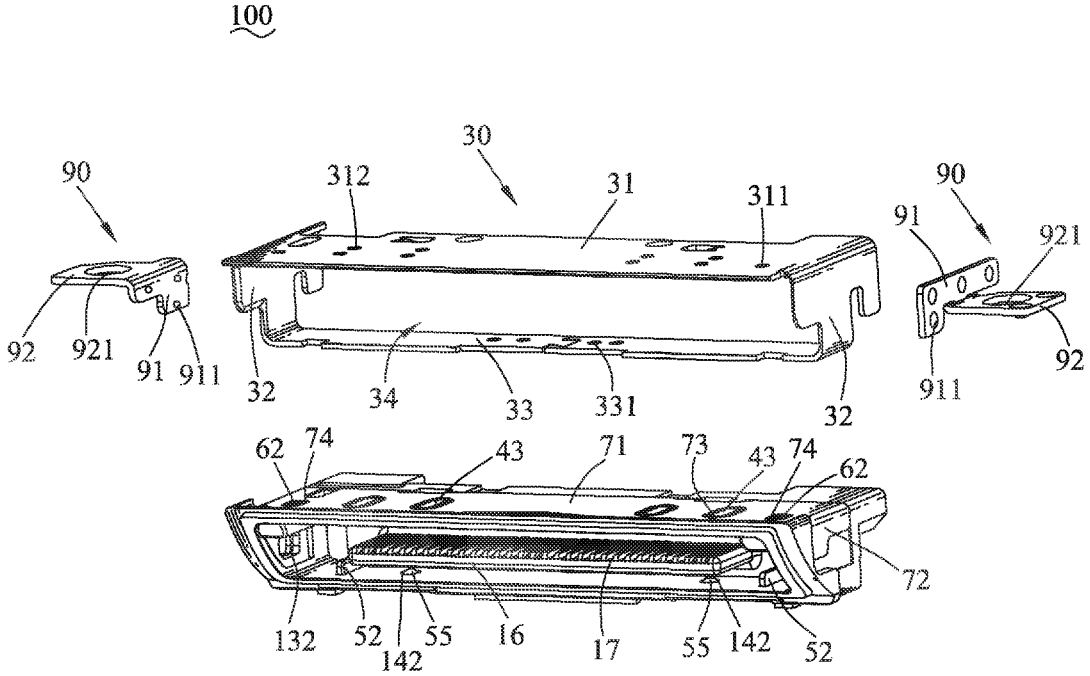
FIG. 3 is a partially exploded view of the receptacle connector of FIG. 1.

With reference to FIGS. 1-3, a receptacle connector 100 in accordance with the present invention is shown. The receptacle connector 100 adapted for soldering with a circuit board (not shown) and engaging with a plug connector (not shown) includes an insulating housing 10, a plurality of terminals 20, a shielding shell 30, a pair of first connecting elements 40, a second connecting element 50, a pair of ground elements 60, a first waterproof board 70, a second waterproof board 80 and a pair of fastening elements 90.

Referring to FIG. 1 and FIG. 2, the insulating housing 10 has a base wall 11, a top wall 12 extending forward from a top of the base wall 11, two side walls 13 extending downward from two opposite sides of the top wall 12, and a bottom wall 14 connecting with the two side walls 13 and the base wall 11. An accommodating chamber 15 for inserting the plug connector therein is formed among the base wall 11, the top wall 12, the two side walls 13 and the bottom wall 14. A middle of a front of the base wall 11 protrudes forward to form a tongue portion 16 projecting in the accommodating chamber 15. The insulating housing 10 defines a plurality of terminal grooves 17 of which each extends longitudinally along a top of the tongue portion 16 and further penetrates through a top of the base wall 11.

The top wall 12 defines two locating grooves 121 transversely spaced from each other. A middle of a bottom wall of the locating groove 121 defines a locating hole (not shown). Each side wall 13 of the insulating housing 10 defines a clipping groove 131 extending vertically to pass through a top of the corresponding side wall 13. Two opposite inner sidewalls of the clipping grooves 131 define two through-holes 132 communicated with the accommodating chamber 15. Two portions of two opposite inner sides of two tops of the two clipping grooves 131 are further spread face to face to form two fixing grooves 133. The bottom wall 14 defines two inserting slots 141 vertically penetrating therethrough, and two circular holes 142 located between the two inserting slots 141.

Referring to FIG. 2, the shielding shell 30 has a rectangular top plate 31, two side plates 32 extending downward from two opposite side edges of the top plate 31, and a bottom plate 33 connecting with bottom edges of the two side plates 32. A receiving space 34 is formed among the top plate 31, the two side plates 32 and the bottom plate 33. The top plate 31 defines two first soldering holes 311 located in two opposite sides thereof, and a plurality of second soldering holes 312 located between the two first soldering holes 311 and symmetrically distributed in the two opposite sides of the top plate 31. The bottom plate 33 defines a plurality of third soldering holes 331 transversely arranged along a straight line and located in a middle of the bottom plate 33.

Referring to FIG. 2, the first connecting element 40 has a base piece 41. Two opposite sides of the base piece 41 extend upward and then extend oppositely to form two locating pieces 42 with two first fastening portions 43 being protruded upward therefrom. The second connecting element 50 has a base plate 51. Two opposite ends of the base plate 51 bend upward to form two insertion plates 52. Two portions of a front side of the base plate 51 are cut off to define two mouths 53. One inner end of each mouth 53 far away from the corresponding insertion plate 52 inclines upward and extends towards the other inner end of the mouth 53 to form a cantilever arm 54. A free end of the cantilever arm 54 spreads outward and protrudes upward to form a hemisphere-shaped touching portion 55. Two portions of a top of the base plate 51 are punched downward to form two second fastening portions 56 spaced from each other and located between the two mouths 53.

Referring to FIG. 2 and FIG. 3, each ground element 60 has a clipping portion 61 disposed vertically with a matching hole (not shown) being opened therein. A front portion of a top of the clipping portion 61 is bent towards a direction perpendicular to the clipping portion 61 to form a contact portion 62.

Referring to FIG. 2, the first waterproof board 70 has a base board 71. Two opposite side edges of the base board 71 extend downward to form two lateral boards 72. The base board 71 defines two guiding holes 74 located at two opposite sides thereof, and two pairs of first fastening holes 73 located between the two guiding holes 74 and transversely arranged at a distance. The second waterproof board 80 defines two spaced second fastening holes 81 transversely located in a middle thereof.

Referring to FIG. 2 and FIG. 3, each fastening element 90 has a first locating piece 91 and a second locating piece 92 perpendicular to the first locating piece 91. The first locating piece 91 defines a plurality of welding holes 911. The second locating piece 92 defines an assembling hole 921.

Referring to FIGS. 1-3, in assembly, the terminals 20 are integrally molded in the terminal grooves 17 of the insulating housing 10 with front ends thereof being exposed to the top of the tongue portion 16 to electrically contact with the plug connector, and rear ends thereof projecting out of the insulating housing 10 through the base wall 11 to be soldered on the circuit board. The second connecting element 50 is mounted to a bottom of the bottom wall 14 with the insertion plates 52 inserted in the inserting slots 141, the touching portions 55 exposed in the accommodating chamber 15 through the circular holes 142 and the second fastening portions 56 exposed under the bottom wall 14. The second waterproof board 80 is mounted under the second connecting element 50 with the two second fastening portions 56 inserted in the two second fastening holes 81 to seal up chinks between the insertion plates 52 and the inserting slots 141 and interstices between the touching portions 55 and the circular holes 142. The locating pieces 42 of each first connecting element 40 are located in two sides of the locating grooves 121, and the base piece 41 is inserted in the locating hole with the first fastening portions 43 exposed beyond a top of the top wall 12 of the insulating housing 10. The clipping portions 61 of the two ground elements 60 are clipped in the clipping grooves 131, the contact portions 62 are fixed in the fixing grooves 133 with the matching holes corresponding to the through-holes 132. The base board 71 of the first waterproof board 70 is mounted on the top wall 12 of the insulating housing 10 with the first fastening portions 43 inserted into the first fastening holes 73 to seal up chinks between the first connecting elements 40 and the locating grooves 121 and chinks between the clipping portions 61 of the ground elements 60 and the clipping grooves 131. The contact portions 62 of the ground elements 60 are exposed outside through the guiding holes 74 of the first waterproof board 70. The lateral boards 72 are attached to two outer surfaces of the two side walls 13 to locate the first waterproof board 70 on the insulating housing 10.

Then a top face of the first waterproof board 70 is coated with waterproof adhesive material to form a waterproof adhesive layer for sealing up interstices between the first fastening portions 43 and the first fastening holes 73 and interstices between the contact portions 62 and the guiding holes 74, and a bottom face of the second waterproof board 80 is also coated with waterproof adhesive material to form a waterproof adhesive layer for sealing up interstices between the second fastening portions 56 and the second fastening holes 81 to prevent moisture entering the accommodating chamber 15 from a top and a bottom of the insulating housing 10. The insulating housing 10 together with the first waterproof board 70 and the second waterproof board 80 surrounded thereon is inserted into the receiving space 34 of the shielding shell 30. The first soldering holes 311 are corresponding to the guiding holes 74, the second soldering holes 312 corresponding to the first fastening holes 73, and the third soldering holes 331 corresponding to the second fastening holes 81. The top plate 31 of the shielding shell 30 connects with the first fastening portions 43 of the first connecting elements 40 by means of a laser welding technology through the second soldering holes 312 and the first fastening holes 73, and the top plate 31 connects with the contact portions 62 of the ground elements 60 by means of the laser welding technology through the first soldering holes 311 and the guiding holes 74 to connect the shielding shell 30 with the first connecting elements 40 and the ground elements 60 firmly so as to make the first connecting elements 40 and the ground elements 60 effectively contact with the plug connector. The bottom plate 33 of the shielding shell 30 connects with second fastening portions 56 of the second connecting element 50 by means of the laser welding technology through the third soldering holes 331 and the second fastening holes 81 of the second waterproof board 80 to connect the shielding shell 30 with the second connecting element 50 firmly so as to make the second connecting element 50 effectively contact with the plug connector. The fastening elements 90 are mounted to two sides of the shielding shell 30 by means of the laser welding technology through the welding holes 911. The receptacle connector 100 is mounted to an external electronic product through the assembling holes 921.

As described above, the top face of the first waterproof board 70 and the bottom face of the second waterproof board 80 are coated with waterproof adhesive material to form the waterproof adhesive layer respectively to seal up the interstices between the first fastening portions 43 and the first fastening holes 73 and the interstices between the contact portions 62 and the guiding holes 74, and the interstices between the second fastening portions 56 and the second fastening holes 81 to prevent the moisture entering the accommodating chamber 15 from the top and the bottom of the insulating housing 10 so as to make the receptacle connector 100 contact with the plug connector steadily. Thus, a normal electrical performance of the external electronic product is assured. Furthermore, the top plate 31 of the shielding shell 30 connects with the first connecting elements 40 and the ground elements 60 by means of the laser welding technology to connect the shielding shell 30 with the first connecting elements 40 and the ground elements 60 firmly so as to make the first connecting elements 40 and the ground elements 60 effectively contact with the plug connector. The bottom plate 33 of the shielding shell 30 connects with the second connecting element 50 by means of the laser welding technology to connect the shielding shell 30 with the second connecting element 50 firmly so as to make the second connecting element 50 effectively contact with the plug connector.

What is claimed is:

1. A receptacle connector adapted for soldering with a circuit board and engaging with a plug connector, comprising:

an insulating housing having a base wall, a top wall, two side walls and a bottom wall which are interconnected with one another to form an accommodating chamber thereamong for inserting the plug connector therein, a front of the base wall protruding forward to form a tongue portion projecting in the accommodating chamber, the insulating housing defining a plurality of terminal grooves of which each extends longitudinally along a top of the tongue portion and further penetrates through the base wall, the top wall defining at least two locating grooves with middles thereof vertically penetrating through the top wall to communicate with the accommodating chamber, the bottom wall defining at least two circular holes communicating with the accommodating chamber;

a plurality of terminals molded in the terminal grooves of the insulating housing with front ends thereof exposed in the top of the tongue portion to electrically contact with the plug connector, and rear ends thereof projecting out of the insulating housing through the base wall to be soldered on the circuit board;

at least two first connecting elements located in the locating grooves with middles thereof projecting into the accommodating chamber through the middles of the locating grooves, two opposite sides of each first connecting element protruding upward to form two first fastening portions;

a second connecting element having a base plate mounted to a bottom of the bottom wall, a front side of the base plate defining at least two mouths, one inner end of each mouth inclining upward and extending towards the other inner end of the mouth to form a cantilever arm, a free end of the cantilever arm spreading outward and protruding upward to form a touching portion projecting into the accommodating chamber through the circular hole, at least two second fastening portions being punched downward from a top of the base plate and located between the two mouths;

a first waterproof board mounted to a top of the top wall of the insulating housing, and defining a plurality of first fastening holes for receiving the first fastening portions therein;

a second waterproof board mounted under the second connecting element, and defining at least two second fastening holes for receiving the second fastening portions therein, wherein a top face of the first waterproof board and a bottom face of the second waterproof board are coated with waterproof adhesive material to form a waterproof adhesive layer respectively; and a shielding shell surrounding the insulating housing together with the first waterproof board and the second waterproof board.

2. The receptacle connector as claimed in claim 1, wherein each side wall of the insulating housing defines a clipping groove extending vertically to pass through a top of the corresponding side wall, two opposite inner sidewalls of the clipping grooves define two through-holes communicated with the accommodating chamber, two opposite inner sides of two tops of the two clipping grooves are further spread face to face to form two fixing grooves, the receptacle connector further includes two ground elements, each ground element has a clipping portion with a matching hole being opened therein, the clipping portions are clipped in the clipping grooves with the matching holes corresponding to the through-holes, a top of the clipping portion is bent towards a direction perpendicular to the clipping portion to form a contact portion fixed in the fixing groove.

3. The receptacle connector as claimed in claim 2, wherein the first waterproof board has a base board which defines two guiding holes located at two opposite sides thereof, and two pairs of the first fastening holes located between the two guiding holes and transversely arranged at a distance, the contact portions of the ground elements are exposed outside through the guiding holes, two opposite side edges of the base board extend downward to form two lateral boards attached to two outer surfaces of the two side walls.

4. The receptacle connector as claimed in claim 3, wherein a top of the shielding shell defines two first soldering holes corresponding to the guiding holes, and a plurality of second soldering holes corresponding to the first fastening holes, a bottom of the shielding shell defines a plurality of third soldering holes corresponding to the second fastening holes, the top of the shielding shell connects with the first fastening portions of the first connecting elements by means of a laser welding technology through the second soldering holes and the first fastening holes, and the top of the shielding shell connects with the contact portions of the ground elements by means of the laser welding technology through the first soldering holes and the guiding holes, the bottom of the shielding shell connects with second fastening portions of the second connecting element by means of the laser welding technology through the third soldering holes and the second fastening holes of the second waterproof board.

5. The receptacle connector as claimed in claim 1, wherein the bottom wall defines two inserting slots vertically penetrating therethrough and located at two sides of the two circular holes, the second connecting element has two insertion plates bending upward from two opposite ends of the base plate and inserted in the inserting slots.

6. The receptacle connector as claimed in claim 1, further comprising two fastening elements, each fastening element having a first locating piece and a second locating piece perpendicular to the first locating piece, the first locating piece defining a plurality of welding holes, the second locating piece defining an assembling hole, the fastening elements being mounted to two sides of the shielding shell by means of a laser welding technology through the welding holes, and the receptacle connector being mounted to an external electronic product through the assembling holes.

* * * * *